US011173994B2

(12) United States Patent
Czubin

(10) Patent No.: US 11,173,994 B2
(45) Date of Patent: Nov. 16, 2021

(54) ERGONOMIC CANOE AND KAYAK PADDLE

(71) Applicant: Dennis James Czubin, New Richmond, WI (US)

(72) Inventor: Dennis James Czubin, New Richmond, WI (US)

( * ) Notice: Subject to any disclaimer, the term of this patent is extended or adjusted under 35 U.S.C. 154(b) by 26 days.

(21) Appl. No.: 16/600,552

(22) Filed: Oct. 13, 2019

(65) Prior Publication Data

US 2021/0107614 A1 Apr. 15, 2021

(51) Int. Cl.
*B63H 16/04* (2006.01)
*B63B 34/26* (2020.01)

(52) U.S. Cl.
CPC ..... *B63H 16/04* (2013.01); *B63B 34/26* (2020.02)

(58) Field of Classification Search
CPC ..... B63H 16/04; B63B 34/26
See application file for complete search history.

(56) References Cited

U.S. PATENT DOCUMENTS 5,127,859 A * 7/1992 Rantilla ..... B63H 16/107 440/104
6,419,601 B1 * 7/2002 Kenner ..... A63B 60/00 473/552
8,684,778 B1 * 4/2014 Bergman ..... B63H 16/04 440/101
10,308,337 B1 * 6/2019 Liveoak ..... B63H 16/04
2008/0302293 A1 * 12/2008 Nesseth ..... B63H 16/105 114/363
2010/0279560 A1 * 11/2010 Hevesi ..... B63H 16/04 440/101
2019/0016428 A1 * 1/2019 McCall ..... B63H 16/06
2019/0315447 A1 * 10/2019 Retter ..... B63H 16/04

* cited by examiner

*Primary Examiner* — Lars A Olson
*Assistant Examiner* — Jovon E Hayes
(74) *Attorney, Agent, or Firm* — Donald R. Boys; Central Coast Patent Agency LLC

(57) ABSTRACT

A watercraft paddle has a composite structure of shaft components joined by adjustable joints enabling the shape of the composite structure and orientation of individual shaft components relative to other shaft components to be altered, a first paddle blade joined at a first outboard end of the composite structure, a second paddle blade joined at a second outboard end of the composite structure, opposite the first outboard end, and a first and a second grip region on the composite structure equally spaced to each side from center for a user to grip the composite structure to paddle the watercraft.

12 Claims, 2 Drawing Sheets

ERGONOMIC CANOE AND KAYAK PADDLE

CROSS-REFERENCE TO RELATED APPLICATIONS

This application claims priority to provisional patent application 62/766,370 filed on Oct. 15, 2018.

DISCLOSURE REGARDING PRIOR DISCLOSURES BY THE INVENTOR OR A JOINT INVENTOR

The inventor has not disclosed this invention prior to the filing of this non-provisional application.

BACKGROUND OF THE INVENTION

1. Field of the Invention

The present description relates generally to a watercraft paddle and more particularly to a paddle for small personal watercraft such as a kayak or canoe, or the like.

2. Disclosure of the Related Art

Traditional kayak paddles comprise two paddle blades connected with a straight shaft. Operation of the traditional kayak paddle requires the operator to alternately flex and extend the wrists, and to alternately raise the elbows above shoulder level. Various modifications have been made to kayak paddles to improve operators' comfort.

One variant of the kayak paddle is the Gullwing Paddle™ which comprises an upward curved central shaft in the grip area with the ends of the shaft and the blades rotated above horizontal. This variant requires the operator to alternately flex and extend the wrists, and to alternately raise the elbows above shoulder level.

Another variant of the kayak paddle is the AngleOar Versa Paddle which comprises a paddle shaft that has two straight shaft ends and a locking joint in the middle, allowing the shaft to be bent in the middle into an inverted "V" shape. This variant decreases the maneuverability of the watercraft, decreases forward thrust efficiency, and requires that the operator raise the elbows above shoulder level.

A further variant of the kayak paddle is Jones, et al, (U.S. Pat. No. 10,407,146), One-Handed, Forearm-Braced Paddle. This variant does not afford the operator the leverage and thus the amount of forward thrust force provided by the traditional two-handed kayak shaft.

A further variant of the kayak paddle is Liveoak; Tal (U.S. Pat. No. 10,308,337), Kayak Fin Paddle. This variant requires the operator to alternately flex and extend the wrists, and to alternately raise the elbows above shoulder level.

Traditional canoe paddles comprise a single blade attached to a straight shaft with a wide or "T" shaped grip for the upper hand. The traditional canoe paddle requires that the operator alternately flex and extend the wrists, and to raise the elbow of the hand gripping the "T" handle above shoulder level.

A variant of the canoe paddle is a straight, two bladed paddle, similar to a kayak paddle, comprising a longer shaft to accommodate the canoeist's higher elevation from the water surface relative to a kayaker.

Clearly, a more ergonomic canoe and kayak paddle design is needed to reduce stress on the operator's joints and ligaments while maintaining or improving paddling maneuverability and efficiency, especially for operators with joint or ligament injuries, such as carpal tunnel syndrome, tendonitis, or rotator cuff injuries. Additionally, a two bladed, two handed configuration is easier for a novice to operate with minimum training.

BRIEF SUMMARY OF THE INVENTION

In one embodiment of the invention a manually operated watercraft paddle is provided, comprising two paddle blades connected by a central shaft that is symmetric or nearly symmetric, wherein the shaft has a series of bends or joints, wherein the first bend outward from the center extends upward, creating a "V" or "U" shape, wherein the central shape positions the shaft below the operator's line of sight to provide an unobstructed forward view, wherein there is a further bend or joint that rotates the shaft in the grip area downward from the initial angle, wherein the top of the hand may be vertical to rotated approximately 45 degrees toward the centerline of the body in respect to the bottom of the hand as the device is operated. In an alternate embodiment, the grip area of the shaft comprises a pair of appendages that may be integral to the shaft or as an attachment to the shaft with said grip appendages rotating the operator's hands axially toward a neutral hand position.

Also in one embodiment is an attachable grip structure comprising a contoured structure that surrounds the shaft in the grip area, wherein the grip structure incorporates a protruding ledge that supports the top of the thumb, wherein the upper portion of the grip structure below the thumb support is reduced in circumference, wherein the middle portion of the grip structure is increased in circumference, wherein the lower portion of the grip structure is reduced in circumference.

In a further embodiment, an attachable wrist or forearm support structure for a manually operated watercraft paddle comprises a pivoting, fixed, ratcheting, or locking beam or shaft, with the distal end protruding from or above the grip structure or paddle shaft, and the proximal end contacting the upper part of the operator's wrist or forearm transmitting force within the paddle shaft from a forward stroke or rearward movement of the paddle, resulting in downward force at the proximal end of the structure's beam or shaft, further transmitting said force to the top of the operator's wrist or forearm.

DETAILED DESCRIPTION OF THE INVENTION

While this invention may be embodied in different forms, there will be described in detail several embodiments with the understanding that the current disclosure should be considered as an example of the principles of the invention and is not intended to limit the invention to the illustrated embodiments. Any numerical values or other specifics provided herein are to be construed as exemplifications of the invention, and are not to be considered as limited thereto. The embodiments, descriptions and illustrations are not to be considered as limiting.

In one embodiment this device is without forearm support. In another embodiment this device is without hand grip bodies. In one embodiment the device is composed of segments that may be extended, retracted, or rotated to the operator's preference. In another embodiment the hand grips are short angled shaft appendages.

While the invention was intended to be hand supported, the device may be supported by a structure attached to the vessel, pivoting at the middle. Such a supporting structure is commercially available and is not shown in the attached drawings.

A canoe or kayak paddle is a manually operated tool to propel a water craft. "A tool becomes 'ergonomic' only when it fits the task you are performing, and it fits your hand without causing awkward postures, harmful contact pressure, or other safety or health risks. Use a tool that allows you to work with a straight wrist."* It should provide for a posture that avoids raising the shoulders and elbows.* The diameter of the grip should be between 1.25 and 2 inches, the preferred grip diameter for tools requiring a "power" grip.*

*NIOSH *Easy Ergonomics: A Guide to Selecting Non-Powered Hand Tools* DHHS (NIOSH) Publication No. 2004-164

Figure 1:
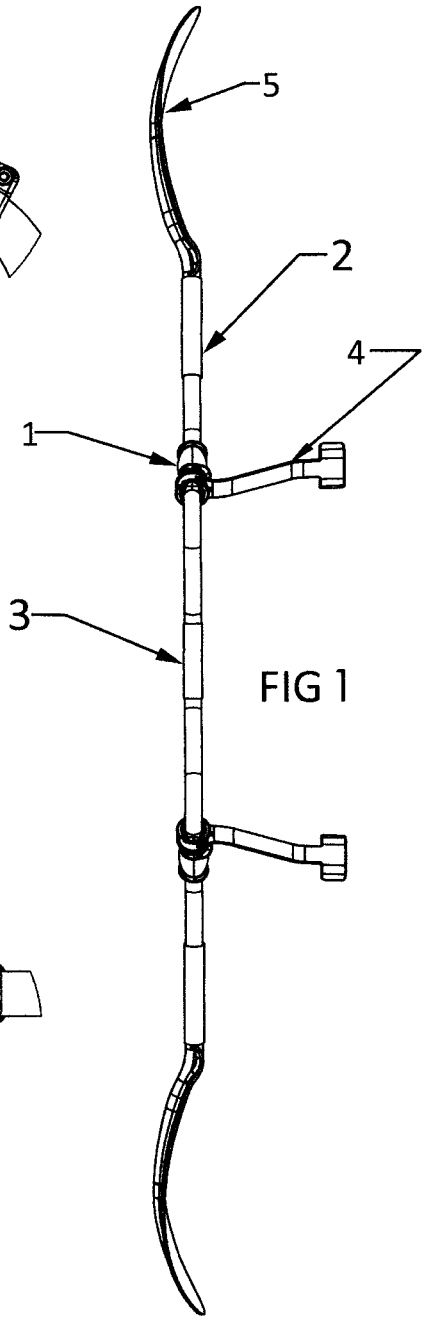
FIG. 1 depicts the top view of the device

In FIG. 1 the device is shown in its planar configuration with grip bodies 1, all shaft components 2, 3, and paddle blades 5 oriented in one plane. Additional embodiments include adjusting the rotation of the blades on their axes to maintain a paddle blade orientation perpendicular to the water surface with a forward tilt of the grip. This may be desirable with the more vertical posture of a canoeist, as opposed to the more reclined posture of a kayaker.

In FIG. 1 the device is shown in the embodiment incorporating the grip bodies 1 and forearm supports 4. The forearm support transmits force during a forward paddling stroke from the rear face of the paddle, through the shaft assembly, through the forearm support, onto the top of the forearm or wrist, reducing the upward twisting force on the wrist. The grip body configuration comprises a size and shape that produces a more comfortable grip during a forward paddle stroke.

Figure 2:
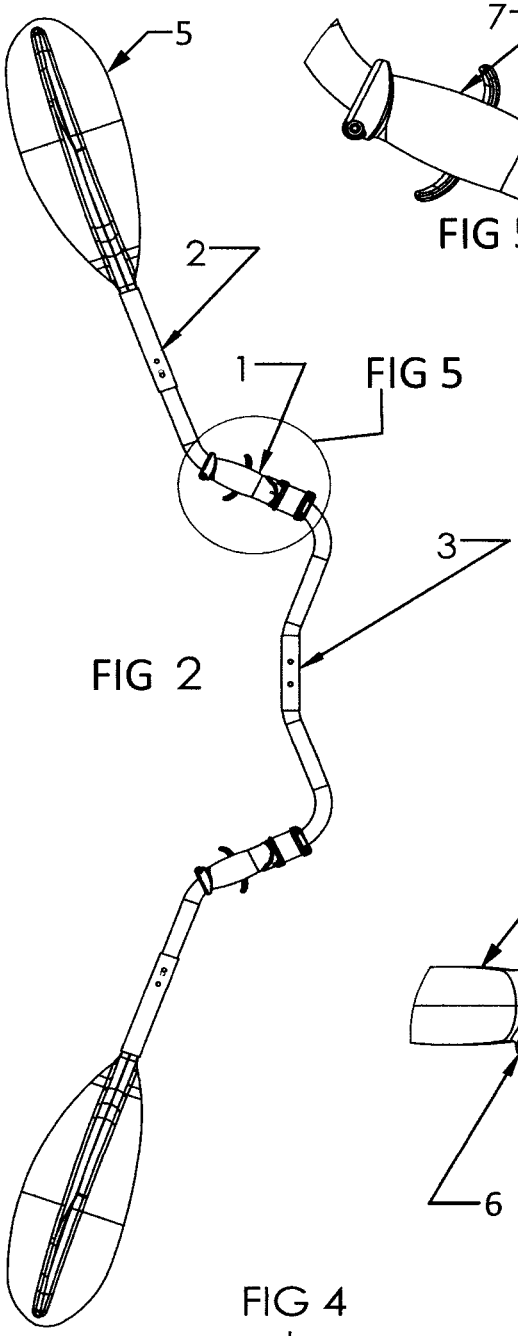
FIG. 2 depicts the front view of the device

In FIG. 2 the device is viewed from the front, facing the operator. The hand grip area of the shaft is depicted with the attached hand grip body 1. Another embodiment is without the hand grip body, wherein the operator would directly grip the shaft in the area depicted by the hand grip body. In other embodiments the shaft in the hand grip area may be bare, be covered in a polymer shrink tube, be covered with a foamed polymer material, or other soft covering typically used on canoe or kayak paddles. The hand grip area of the shaft from the center of the device is rotated downward from the horizontal to provide a more neutral hand position, similar to the "10 o'clock and 2 o'clock" hand positions on an automotive steering wheel, which produces less strain on the wrist than current state of the art paddles.

In FIG. 2 the portion of the shaft 2 extending to the paddle blade may extend from the horizontal to approximately a 45 degree angle below horizontal. The positioning of the paddle blades below the hand grips results in the operator keeping the elbows below shoulder level during the entire stroke cycle, which produces less strain on the shoulder than current state of the art paddles.

In FIG. 2 the paddle blade location below the level of the hand grip 1 affords another benefit wherein the paddle blade may remain horizontal to below horizontal during the entire forward thrust and subsequent recovery stroke, resulting in very little of the water that clings to the surface of the paddle or shaft entering the vessel.

Figure 3:
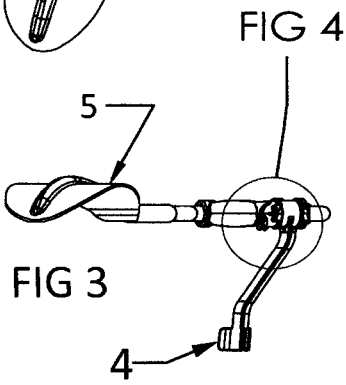
FIG. 3 depicts a side view of the device

FIG. 3 shows the relative positions of the paddle blade 5, and the forearm support 4 in relation to the plane of the shaft assembly.

In FIG. 3 the paddle blade 5 is shown parallel to the plane of the shaft assembly. In another configuration the paddle blade may be rotated to provide the operator a more comfortable grip with a more vertical posture while maintaining vertical orientation of the blade in relation to the water surface. In another configuration, the hand grips are rotated forward to provide a more relaxed grip.

Figure 4:
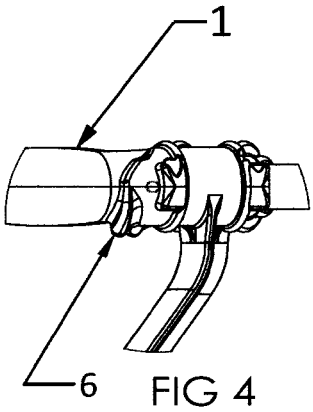
FIG. 4 depicts an enlarged side detail view of top of the grip body

In FIG. 4 the thumb support 6 is shown on the grip body 1. The thumb support helps maintain the shaft position within the hand so that the operator can control the paddle with less compression of the fingers squeezing around the shaft, reducing stress in the carpal tunnel. The thumb support also transmits force from the forward stroke to the top of the thumb, also reducing the required compression of the fingers and thumb.

Figure 5:
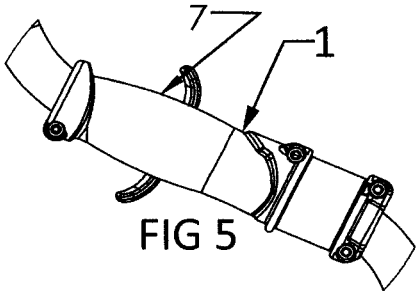
FIG. 5 depicts an enlarged front detail view of the grip body

In FIG. 5 the hand grip body 1 is shown with the central surface of the gripping surface 7 with a larger diameter than the two ends, allowing the grip body to better fit the inner contour of the hand. Other embodiments may include a straight cylindrical grip area, circumferential grooves for individual fingers, a longitudinal groove or ridge for the finger tips to engage, or other configurations common to hand tools.

Figure 6:
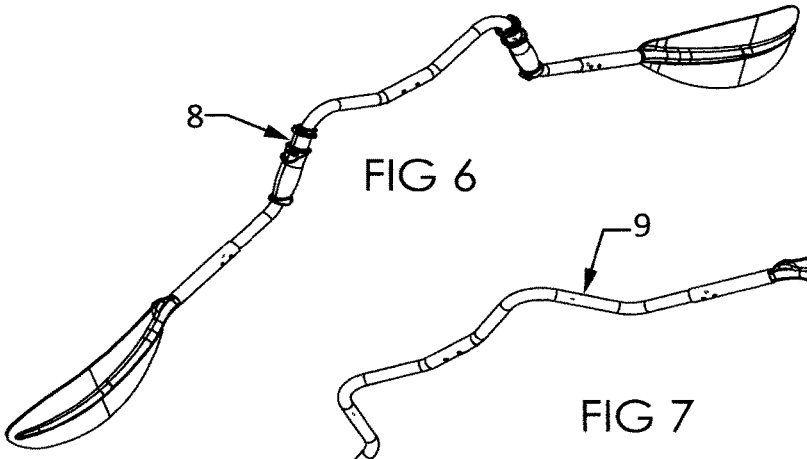
FIG. 6 depicts a top profile view of an embodiment of the device without forearm supports

In FIG. 6 the device is an embodiment with the grip bodies 1 but without the forearm supports 4.

Figure 7:
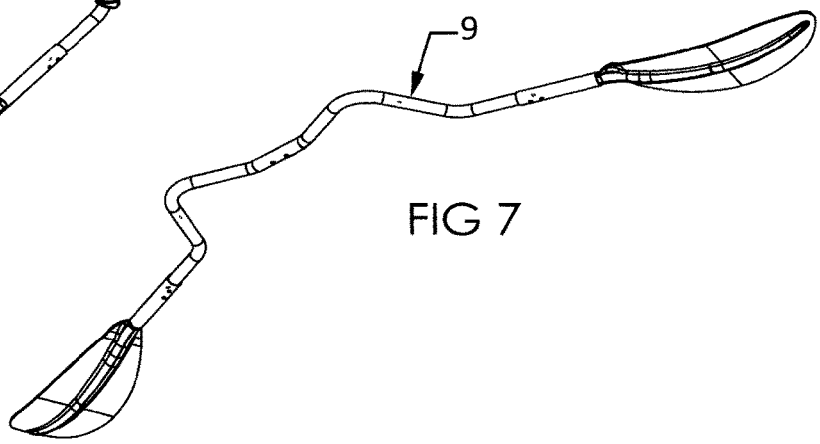
FIG. 7 depicts a top profile view of an embodiment of the device without grip bodies

In FIG. 7 the device is an embodiment without grip bodies 1 and without the forearm supports 4, showing the grip area of the shaft 9 being bare.

Figure 8:
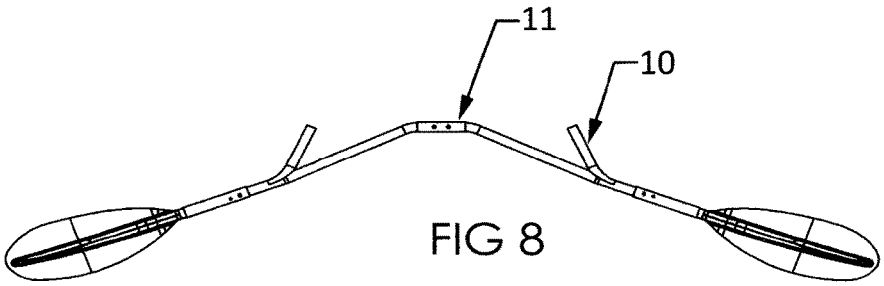
FIG. 8 depicts a front view of an embodiment without lowered center section and angled grips depicted as appendages to the straight end shafts

FIG. 8 shows an embodiment wherein the grip area of the shaft 10 is an appendage onto the shaft rotated upward from the axis of the shaft. An alternate embodiment comprises the grip appendages attached below the shaft.

FIG. 8 shows an embodiment wherein the shaft forms an inverted "V" without the center section 11 being lowered below the line of sight of the operator. A further embodiment may comprise the section of shaft between the two grip appendages 10 being straight. A further embodiment may comprise the entire shaft being straight with two grip appendages located approximately as shown in FIG. 8.

Figure 9:
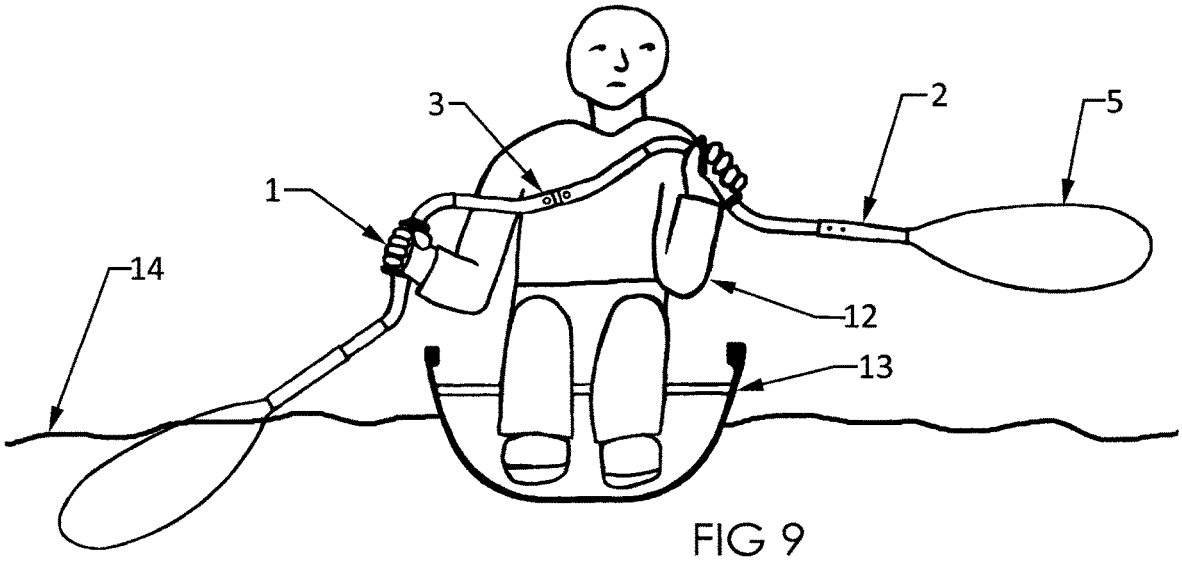
FIG. 9 depicts a front view of the device being operated by a canoeist seated in a canoe, viewed facing the operator with the canoe cut away

FIG. 9 depicts a canoe 13 on the surface of water 14 with a canoeist operating the device as embodied in FIG. 1.

FIG. 9 depicts the forward stroke with the right paddle blade while simultaneously depicting the recovery stroke with the left paddle blade 5. During the forward stroke the right hand on the grip body 1 maintains a neutral position with the top of the hand rotated inward. During the recovery stroke the left hand also maintains a neutral position with the top of the hand turning more inward from that of the forward stroke.

In FIG. 9 the operator's elbow 12 does not rise above level of the shoulder during the entire stroke cycle, reducing strain on the shoulder.

In FIG. 9 the angle of the section of the shaft 2 attached to the paddle blade 5 stays below horizontal during the entire recovery stroke, reducing the amount of water entering the vessel via gravity from water clinging to the paddle blade and shaft.

In FIG. 9 the center section of the shaft 3 is lowered below horizontal to clear the operator's line of sight. In alternate embodiments the center section of the shaft may be horizontal or curved upward.

What is claimed is:

1. A watercraft paddle, comprising: a composite structure of shaft components joined by adjustable joints enabling the shape of the composite structure and orientation of individual shaft components relative to other shaft components to be altered, the composite structure comprising a central component spanning equally to each side of a point central between the paddle blades, the central component having one or more joints adjusted with the central component formed in a shape of an inverted English letter U with a horizontal center region and first and second upwardly extending regions to each side of the central region, a first outboard component joined to a first end of the central component, and a second outboard component joined to a second end of the central component; a first paddle blade joined at an outboard end of the first outboard component; a second paddle blade joined at an outboard end of the second outboard component, and a first grip region on the first upwardly extending region of the central component, and a second grip region on the second upwardly extending region of the central component, for a user to grip the composite structure to paddle the watercraft.

2. The watercraft paddle of claim 1 wherein the composite structure is adjusted to be symmetrical about a point central between the paddle blades.

3. The watercraft paddle of claim 1 wherein the outboard components each are joined to one of the upwardly extending regions of the central component by joints adjusted with one or both of the outboard components extending at a downward angle from horizontal.

4. The watercraft paddle of claim 3 wherein the hand grip regions are both implemented on the outboard components extending at a downward angle from horizontal.

5. The watercraft paddle of claim 4 wherein the hand grip regions are covered each with a polymer shrink tube or a polymer foam material, and are contoured to enhance the user's grip.

6. The watercraft paddle of claim 1 further comprising a first and a second hand grip body assembled over the first and second hand grip regions, the hand grip bodies adapted to be removable from then hand grip regions.

7. The watercraft paddle of claim 6 wherein each hand grip body comprises a thumb support implemented to engage the user's thumb of each hand as the user grips the hand grip bodies, the thumb support transmitting force from a forward stroke to the top of the user's thumb, reducing required compression of the fingers and thumb to securely grip the watercraft paddle.

8. The watercraft paddle of claim 4 wherein the hand grip regions are appendages coupled to and extending upward or downward away from an axis of the outboard components.

9. The watercraft paddle of claim 8 further comprising first and a second hand grip bodies assembled over the first and second appendages, the hand grip bodies adapted to be removable from the appendages.

10. The watercraft paddle of claim 1 further comprising a first and a second attachable forearm support structure, each forearm support structure attached to the composite structure proximate the first and the second grip regions each, forearm support structure having a proximal region positioned to contact the user's wrist or forearm in a manner that the user transmits force to the composite structure with the forearm support structures as well as with the hand grips.

11. The watercraft paddle of claim 10 wherein the forearm support structures are coupled to the composite structure by joints that are pivotable or ratceting, such that the forearm support structure are adjustable.

12. The watercraft paddle of claim 1 wherein the first and second paddle blades are joined to the composite structure by rotatable and angular joints such that the paddle blades are adjustable to be angled either upward or downward from the direction of an axis of the shaft component of the composite structure where joined, and rotatable around an axis of the shaft component of the composite structure where joined.

* * * * *